United States Patent [19]

Yamaoka

[11] 3,999,296

[45] Dec. 28, 1976

[54] ELECTRIC SHAVER CUTTER OF IMPROVED EFFICACY

[75] Inventor: Goichi Yamaoka, Okaya, Japan

[73] Assignee: Kabushiki Kaisha Suwa Seikosha, Tokyo, Japan

[22] Filed: Feb. 19, 1976

[21] Appl. No.: 659,200

Related U.S. Application Data

[63] Continuation of Ser. No. 501,385, Aug. 28, 1974, abandoned.

[30] Foreign Application Priority Data

Aug. 28, 1973 Japan ..... 48-96447

[52] U.S. Cl. ..... 30/346.51

[51] Int. Cl.[2] ..... B26B 19/04

[58] Field of Search ..... 30/346.51, 346.55, 346.6, 30/346.61

[56] References Cited

UNITED STATES PATENTS

| | | | |
|---|---|---|---|
| 3,064,348 | 11/1962 | Wahl | 30/346.51 X |

FOREIGN PATENTS OR APPLICATIONS

| | | | |
|---|---|---|---|
| 870,959 | 3/1953 | Germany | 30/346.51 |
| 1,114,115 | 9/1961 | Germany | 30/346.51 |
| 428,000 | 12/1947 | Italy | 30/346.51 |

*Primary Examiner*—Gary L. Smith

*Attorney, Agent, or Firm*—Blum, Moscovitz, Friedman & Kaplan

[57] ABSTRACT

The efficacy of an electric shaver cutter of the vibratory type is improved by providing a region proximate but not at the cutting edge which differs in thickness from the adjacent portions of the cutter. The difference in thickness results in changes in the vibratory amplitude and frequency of the cutter.

8 Claims, 6 Drawing Figures

ELECTRIC SHAVER CUTTER OF IMPROVED EFFICACY

This is a continuation of application Ser. No. 501,385, filed Aug. 28, 1974 now abandoned.

BACKGROUND OF THE INVENTION

As is evident, the sharpness of the cutter and its positional relationship to the comb are important elements in the operational efficacy of electric shavers of the vibratory type. Another factor is the vibrational frequency. The more rapid the vibration, the greater the number of cutting strokes which will take place as the shaver is moved over the skin. The frequency of vibration will depend on the motor and on the weight of the cutter itself. In the interest of high vibrational frequency, the weight of the cutter blade has been reduced about as far as is practical; however, it would be desirable that still higher frequencies be attained.

SUMMARY OF THE INVENTION

The vibrational frequency of an electric shaver cutter operating in the vibrational mode is increased by providing a region of different thickness proximate the cutting edge of the cutting blade or cutter. This region of different thickness may be either a depression or a projection. Further, the depression may be so deep that in the limiting case it is an aperture through the cutter. For a relatively long cutter edge, there may be a plurality of depressions, projections or apertures proximate the cutting edge.

Where the region of different thickness is a depression or an aperture, the weight of the cutter is decreased and the amplitude of vibration of the cutting edge can be greater than that which would normally correspond to the remainder of the cutter were there not such a depression or aperture present. Where the region of different thickness is a projection or a ridge, the increase in thickness increases the stiffness of the cutter which tends to increase the resonant frequency of the system.

Accordingly, an object of the present invention is an electric shaver cutter of improved efficacy, said improvement in efficacy being provided by the presence of a region of different thickness from that of the adjacent portions of the cutter, said region of different thickness being proximate but not at the cutting edge of the cutter.

Another object of the present invention is an electric shaver cutter of improved efficacy wherein said cutter has a region of different thickness from the remainder of the cutter, said region of different thickness being a depression, an aperture or a projection.

A further object of the present invention is an electric shaver cutter of improved efficacy wherein said cutter has a plurality of regions of thickness different from the remainder of the cutter, said plurality of regions of different thickness being adjacent but not at the cutting edge of said cutter.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
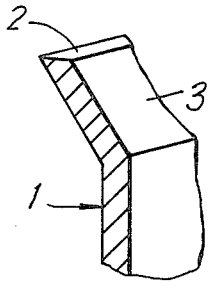
FIG. 1 PRIOR ART
FIG. 1 is a partial sectional view of a cutter in accordance with the prior art.

A fragmentary sectional view of the edge of a cutter in accordance with the prior art where said cutter is a part of an electric shaver operating in a vibratory mode is shown in FIG. 1 where the cutter itself is indicated by the reference numeral 1. The cutting edge 2 is formed in the top part 3 of the cutter 1.

Figure 2:
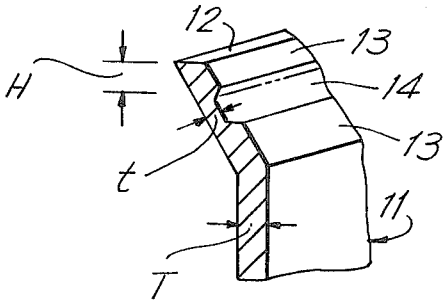
FIG. 2 is a partial sectional view of a cutter in accordance with the present invention.

An embodiment of the invention is shown in a fragmentary sectional view in FIG. 2 in which the cutter is indicated generally by the reference numeral 11. Cutter edge 12 is formed in top portion 13. Proximate edge 12 is a region 14 of different thickness from the adjacent portions indicated by the reference numerals 13 of the cutter blade 11. The region 14 is at a distance H from the cutting edge 12, and the thickness of the region of different thickness is indicated by the letter $t$. The thickness of the adjacent portion of the cutter is indicated by the letter T.

As aforenoted, $t$, namely the thickness of portion 14 may be either less or greater than T, the thickness of the adjacent portion of the cutter 11.

Figure 3:
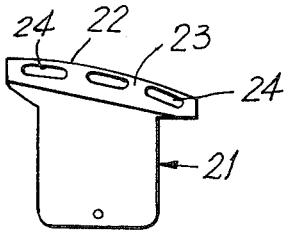
FIG. 3 is an elevational view of an embodiment of the present invention.

The distance H from edge 12 depends upon the form of the particular cutter, but, in general, the distance should be at least 0.2 mm for the construction to be effective. Moreover, the region of different thickness need not necessarily be continuous. It may be formed intermittently as shown in FIG. 3, an elevational view of a face of the cutter. The cutter is here represented generally by the reference numeral 21, 22 indicating the edge of the cutter and 23 indicating the portion of the cutter adjacent to the region of different thickness. The region of different thickness is indicated by the reference numeral 24 which, in FIG. 3 may represent either a depression or an elevation, i.e. a groove or a ridge. Further, the region indicated by the reference numeral 24 may be an aperture penetrating from one face of cutter 21 to the opposite face.

A particularly suitable configuration is one in which $H = 1$ mm and $t/T = 0.5$. In other words, the region of different thickness is a depression and the thickness of the cutter in the depression is half that of the thickness of the remainder of the cutter or, at least, of the adjacent portions of the cutter. Frequently, in a cutter of conventional configuration, the vibrational frequency is 5kHz. However, when modified as in accordance with the present invention, that is by inclusion of a region of different thickness, the frequency of the cutter rises to between 7 and 10 kHz. This difference of frequency is, of course, readily noticeable as a difference in pitch during use of the electric shaver incorporating such a cutter. Moreover, the amplitude of vibration which is evident as a difference in the volume of sound emitted is from 1.5 to two times as great as that of conventional cutters.

Figure 4:
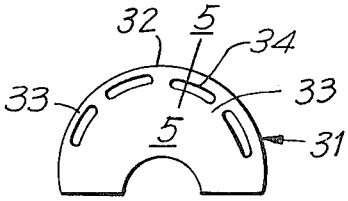
FIG. 4 is an elevational view of a second embodiment of the present invention.
Figure 5:
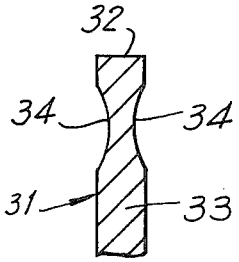
FIG. 5 is a sectional view taken along line 5—5 of FIG. 4.

The cutters can take a variety of shapes. For instance, a cutter in accordance with the present invention can be semicircular as shown in FIG. 4. By the use of one or more grooves or ridges, grooves or apertures being preferred, the change in frequency of vibration and the improvement in cutting efficacy can be conferred on such an embodiment. The cutter of FIG. 4, indicated generally by the reference numeral 31 has a cutting edge 32, a blade 33 and grooves 34. The cutter of FIG. 4 is shown in cross-section in FIG. 5 in which it can be seen that grooves 34 are formed in opposite faces of the cutter so that the grooves are opposed to each other. As shown in the embodiment of FIG. 5, $t/T$ is about 0.5.

Figure 6:
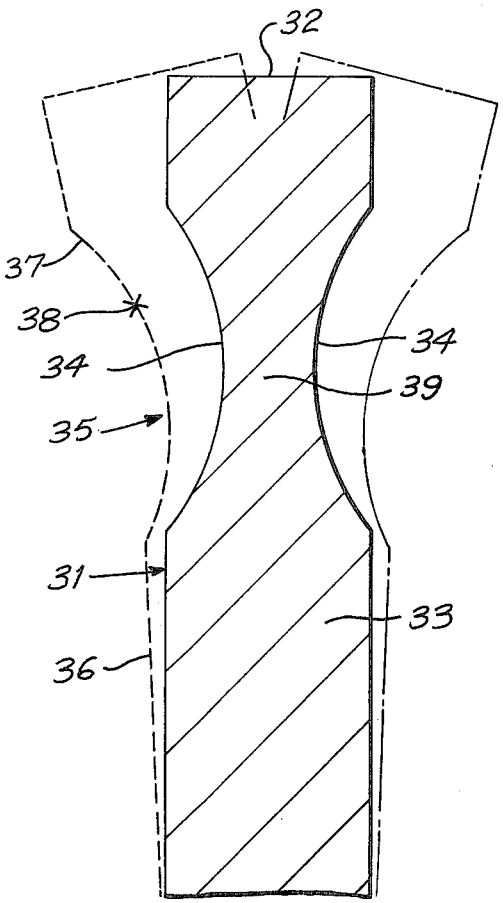
FIG. 6 illustrates the increase in vibration amplitude resulting from the decrease in thickness near the edge of the cutter of FIG. 5.

FIG. 6 shows how the depressions 34 result in an increase in the amplitude of vibration of tip 32. The dashed lines indicate the boundary positions of cutter 31 at the crest of each vibration. Thus the dashed line indicated generally by the reference numeral 35 shows the shape of the left edge of the cutter at the limit of its excursion to the left during vibration. However, the portion 36 of line 35 if extended upwardly would intersect curved portion 37 at the point 38 indicated as x. It is therefore clear that flexing is taking place about a thinner portion 39 of the cutter. It is this additional flexing which accounts for the fact that the amplitude of vibration increases by up to a factor of about 2 as the result of the presence of a depression or aperture or thinner portion, in general, proximate but not at the edge of the cutter. This increase in amplitude of vibration inherently results in passage of the cutter edge over a greater portion of the usual comb for each stroke of the cutter, and, consequently, more rapid shaving.

As aforenoted, the invention is characterized in that the vibrational mode of the cutting edge can be changed by providing either projections or recesses, including apertures, either continuously or intermittently in a region near the edge of the cutter. The size and number and shape of the projections or recesses, including apertures, can be chosen at will in accordance with the shape of the edge and the weight, shape and material of the cutting blade. Moreover, a variety of production methods such as pressing, grinding, etc. may be used for formation of the regions having a thickness different from that of the adjacent portions of the cutter.

Interestingly, it has been found that not only is the tendency to pull the beard or irritate the skin during shaving decreased, but the higher pitch resulting from the modified configuration of the cutter is pleasant. Moreover, the cutter, modified in accordance with the present invention, may be used with a motor using any driving principle.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An electrical shaver cutter of improved efficacy, said cutter being of the vibratory type, wherein the stiffness of said cutter is decreased and thereby the vibration frequency and amplitude of said cutter are increased by the presence of a region of thickness smaller than that of the adjacent portion of said cutter, said region being proximate but spaced apart from the cutting edge of said cutter.

2. The electrical shaver cutter as defined in claim 1, wherein said region is a depression.

3. The electrical shaver cutter as defined in claim 1, wherein said region is an aperture.

4. The electrical shaver cutter as defined in claim 1, wherein said region of smaller thickness is at a distance of at least 0.2 mm from said cutting edge.

5. The electrical shaver cutter as defined in claim 1, wherein said region of smaller thickness is a depression at a distance of about 1 mm from said cutting edge.

6. The electrical shaver cutter as defined in claim 5, wherein the thickness of said region is about 0.5 times that of the adjacent portion of said cutter.

7. The electrical shaver cutter as defined in claim 1, wherein said cutter has depressions on both faces thereof at the same region thereof.

8. The electrical shaver cutter as defined in claim 1, wherein the thickness of said region of smaller thickness is such as to increase the amplitude of vibration by a factor of 1.5 to 2 times that characteristic of such a cutter absent said region of smaller thickness.

* * * * *